US005792266A

United States Patent [19]

Falia et al.

[11] Patent Number: 5,792,266

[45] Date of Patent: *Aug. 11, 1998

[54] HOT IMMERSION COATING OF STEEL SHEET SURFACES

[75] Inventors: Horacio Carlos Falia, Remedios de Escalada; Carlos Ignacio Rojas, Lanús-Buenos Aires; Federico Arturo Turtl, Adrogué-Buenos Aires, all of Argentina

[73] Assignee: Comesi S.A.I.C., Buenos Aires, Argentina

[ * ] Notice: The term of this patent shall not extend beyond the expiration date of Pat. No. 5,589,227.

[21] Appl. No.: 693,508

[22] Filed: Aug. 8, 1996

Related U.S. Application Data

[63] Continuation-in-part of Ser. No. 413,307, Mar. 30, 1995, abandoned.

[30] Foreign Application Priority Data

Aug. 30, 1994 [AR] Argentina ..... 329.258

[51] Int. Cl.[6] ..... B05C 1/00

[52] U.S. Cl. ..... 118/413; 118/104; 118/118; 118/123; 118/203; 118/244; 118/261; 427/356; 427/428; 427/434.2

[58] Field of Search ..... 118/63, 70, 104, 118/118, 123, 203, 244, 261, 262, 413, 414; 427/348, 349, 356, 359, 428, 434.2; 162/281; 101/157, 169, 365; 15/256.5, 256.51

[56] References Cited

U.S. PATENT DOCUMENTS

| | | | |
|---|---|---|---|
| 4,172,911 | 10/1979 | Michels | 118/63 |
| 4,288,476 | 9/1981 | Wald et al. | 427/349 |
| 4,719,129 | 1/1988 | Caudill | 427/348 |
| 5,072,689 | 12/1991 | Nakagawa et al. | 118/419 |
| 5,393,344 | 2/1995 | Oyagi et al. | 118/63 |

*Primary Examiner*—Laura Edwards
*Attorney, Agent, or Firm*—Kuhn and Muller

[57] ABSTRACT

A device for coating steel sheet surfaces by hot immersion in continuous coating lines, is provided, including several driving rollers disposed against the surface of the sheet to be coated, complemented by tensioning rollers and an inert gas stream, in this case nitrogen, acting on the cutting edges of the scrapers and against the surface of the coating driving rollers.

4 Claims, 1 Drawing Sheet

HOT IMMERSION COATING OF STEEL SHEET SURFACES

This application is a continuation-in-part of application Ser. No. 08/413,307, filed Mar. 30, 1995 now abandoned.

FIELD OF THE INVENTION

The instant invention relates to improvements in devices for coating steel sheet surfaces by hot immersion in continuous coating lines.

BACKGROUND OF THE INVENTION—PRIOR ART

As known, it is a requirement for the continuous coating of a cold rolled steel sheet that a forward roller located towards the vertical line of the steel band be included within the non-ferrous alloy bath. Generally, the roller used is a single roller having a diameter of about 500 mm or higher, assisted by tensioning rollers of lower diameter in order to maintain stable the passage of the sheet against the members draining the excess of the molten alloy which is entrained from the bath by the steel band. Such a roller has an angle embraced by the sheet contacting the roller of at least 120° which results in a large contact surface between the sheet and the roller. This large contact surface is harmful since it tends to trap molten alloy between the roller and the sheet, which causes sheet deformation since molten metal cannot escape therefrom.

In order to solve this disadvantage, immersed rollers adopt different configurations to minimize the mentioned effect. Among the most usual configurations, holes are drilled at the roller surface along with slots in order to facilitate displacement of molten metal towards the holes. Further, the large angle involved by the contact of a portion of the sheet upon the roller makes the deformation produced by alloy product accumulation on the roller more notorious, which is minimized by the use of nitrogen fed mechanical scrapers, but the effect of nitrogen-aided scraping is more notorious in the case of tensioning rollers of a lower diameter. This is due to the higher angular speed of the roller, which increases as the roller diameter decreases. The higher angular speed facilitates scraping due to the higher frequency of the passage of each roller generatrix in front of the scraper. Further, a lower embracing angle of tensioning rollers disfavors marking of the sheet due to roller deformation.

Taking into account the above, the novelty of the present invention resides in multiple forward rollers provided with nitrogen-assisted mechanical scrapers, thus obtaining, as shown in the case of three rollers shown in FIG. 1 herein, an improvement in the quality of material produced by this process, since the possibility of deformation produced by a large diameter roller involving a large angle is prevented.

DETAILED DESCRIPTION OF THE PREFERRED EMBODIMENT

Figure 1:
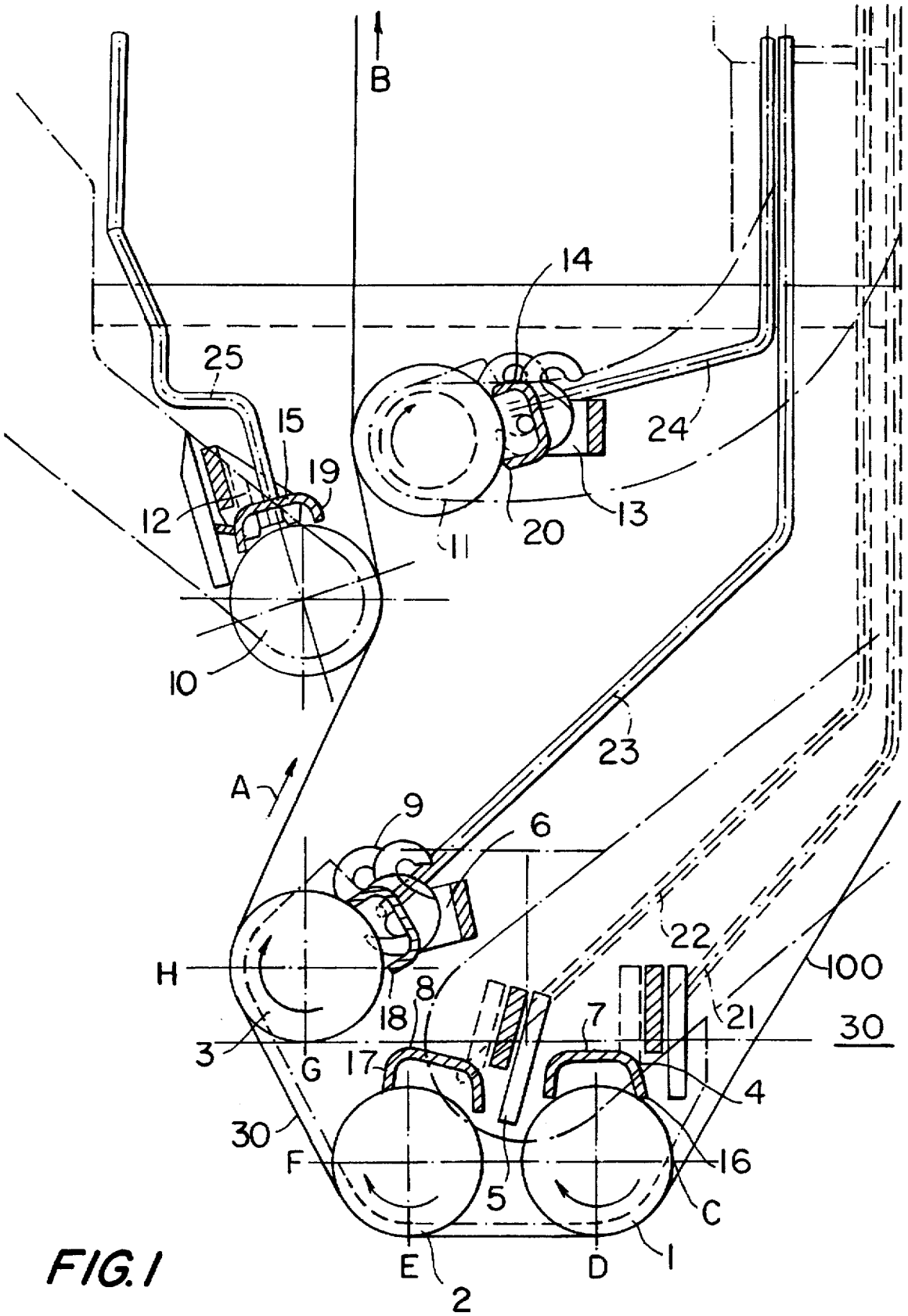
FIG. 1 is a vertical section of the apparatus of the present invention for hot immersion coating of steel sheet surfaces.

As shown in FIG. 1, steel sheet 10 is advanced through a coating bath in coating tank 38.

FIG. 1 is a vertical section of the assembly showing multiple forward rollers 1, 2 and 3 of equal diameter, which have scraper support boxes 4, 5 and 6 to which scrapers 7, 8 and 9, respectively, are linked.

Tensioning rollers 10 and 11 mounted downstream of forward rollers 1, 2 or 3 on parallel shafts have in front of them scraper support boxes 12 and 13 containing scrapers 14 and 15.

Cutting edges are designated with numerals 16, 17, 18, 19 and 20, and correspond to rollers 1, 2, 3, 10 and 11, respectively.

Conduits carrying inert gas, nitrogen in this case, 21, 22, 23, 24 and 25, end into the scraper support boxes 4, 5, 6, 12 and 13, respectively.

A description of multiple roller arrangement replacing the single roller of larger diameter is shown in FIG. 1. As also shown in FIG. 1, the respective embracing angles of the contact surfaces each of rollers 1,2 or 3 against steel sheet 30 is less than 90° for each roller 1, 2 or 3. For example, sheet 30 contacts an arcuate portion of roller 1 which is less than the quadrant C-D representing 90° of roller 1. Sheet 30 also contacts an arcuate portion of roller 2 which is less than the quadrant E-F representing 90° of roller 2. Furthermore, sheet 30 contacts an arcuate portion of roller 3 which is less than the quadrant G-H representing 90° of roller 3. Therefore, at any one time, sheet 30 contacts rollers 1, 2 or 3 at embracing angles of less than 90° each.

In contrast, in a conventional arrangement of the single roller with nitrogen assisted scrapers, a sheet is forwarded in the direction "A" towards the vertical line B by means of a roller having a diameter larger than 400 mm with an angle of the sheet over the roller higher than 120°. This causes a large contact surface which is disadvantageous, since in spite of the improvement introduced by the nitrogen-assisted scraping, any deformation of the roller is reproduced on the sheet. Further, scraping on smaller diameter rollers is more effective due to the more frequent passage of possible scales on the roller through the scraper.

Due to the above, the novelty of the present invention resides in the use of multiple forward rollers for attaining return of the sheet towards the vertical line with a minimal embracement angles, by means of the distribution of the contact angle of a single roller in at least two rollers, which allows smaller contact angles and higher scraping speeds, thus eliminating marks and corrugations on the sheet produced by the aforementioned large surface contact, which contact is prevented by this process.

It is further noted that other modifications may be made to the present invention without departing from the scope of the present invention, as noted in the appended claims.

We claim:

1. A device for coating steel sheet surfaces by hot immersion in continuous coating lines in a bath in a coating tank, wherein a steel sheet is advanced over a roller during coating, said device comprising a plurality of rollers contacting the steel sheet, during advancement of the steel sheet past said plurality of rollers, said device further comprising a plurality of nitrogen-assisted mechanical scrapers having cutting edges contacting said plurality of rollers, and said device further including a source feeding nitrogen towards said plurality of rollers, and a means for reducing the presence of molten alloy between each of the rollers and the steel sheet, said means comprising each of said rollers having a steel sheet contacting surface with a reduced embracing angle contacting the steel sheet, wherein the respective embracing angle of each of said rollers against the steel sheet is less than 90° for each said roller.

2. The device, as claimed in claim 1, wherein said plurality of rollers comprises three rollers.

3. The device for hot treatment and immersion of the steel sheet as claimed in claim 1, wherein the steel sheet is carried by said plurality of rollers to be forwarded towards a pre-determined vertical line with the simultaneous action of said mechanical scrapers and the provision of nitrogen gas thereto, and at least two further tensioning rollers provided downstream from said rollers therewith, said two tensioning rollers advancing the steel sheet towards the predetermined vertical line.

4. A process for coating steel sheet surfaces comprising passing a steel sheet during coating against a plurality of rollers, and feeding a source of nitrogen gas against said rollers, wherein respective embracing angles of each respective contact surface of each of said rollers against the steel sheet is less than 90° for each said roller.

* * * * *